United States Patent [19]

Seel

[11] 4,358,878

[45] Nov. 16, 1982

[54] PLUG-IN FASTENER FOR MOTOR VEHICLE SAFETY BELTS

[75] Inventor: Holger Seel, Hamburg, Fed. Rep. of Germany

[73] Assignee: Autoflug GmbH, Rellingen, Fed. Rep. of Germany

[21] Appl. No.: 188,069

[22] Filed: Sep. 17, 1980

Related U.S. Application Data

[63] Continuation of Ser. No. 921,262, Jul. 3, 1978, abandoned.

[30] Foreign Application Priority Data

Jul. 2, 1977 [DE] Fed. Rep. of Germany ..... 2730003

[51] Int. Cl.[3] ..... A44B 19/00; E05B 63/20

[52] U.S. Cl. ..... 24/230 A; 292/333; 292/336; 24/230 AL

[58] Field of Search ..... 24/230 AL, 230 A; 292/333, 334, 336

[56] References Cited

U.S. PATENT DOCUMENTS

| | | | |
|---|---|---|---|
| 299,140 | 5/1884 | Hill | 292/334 |
| 562,077 | 6/1896 | Hasshagen | 292/333 |
| 887,354 | 5/1908 | Sterrett | 292/333 |
| 1,330,693 | 2/1920 | Fisher | 292/335 |
| 1,372,923 | 3/1921 | Anderson | 292/335 |
| 1,444,499 | 2/1923 | Fisher | 292/335 |
| 2,570,390 | 10/1951 | Schuldt | 292/335 |
| 2,698,197 | 12/1954 | Jacobson | 292/336 |
| 2,793,896 | 5/1957 | Duvall | 292/333 X |
| 3,593,389 | 7/1971 | Nygren | 24/230 A |
| 4,000,548 | 1/1977 | Stephenson et al. | 24/230 AL |
| 4,060,879 | 12/1977 | Takada | 24/230 A |
| 4,065,836 | 1/1978 | Stephenson | 24/230 AL X |
| 4,068,354 | 1/1978 | Loomba et al. | 24/230 AL X |
| 4,069,557 | 1/1978 | Loomba | 24/230 AL |

FOREIGN PATENT DOCUMENTS

| | | | |
|---|---|---|---|
| 274321 | 5/1914 | Fed. Rep. of Germany | 292/333 |
| 695112 | 8/1940 | Fed. Rep. of Germany | 292/335 |
| 698631 | 11/1940 | Fed. Rep. of Germany | 292/335 |
| 544319 | 6/1922 | France | 292/335 |
| 1102822 | 10/1955 | France | 292/334 |
| 516692 | 1/1940 | United Kingdom | 292/335 |
| 759978 | 10/1956 | United Kingdom | 292/333 |

*Primary Examiner*—Ramon S. Britts
*Assistant Examiner*—Carl F. Pietruszka
*Attorney, Agent, or Firm*—Becker & Becker, Inc.

[57] ABSTRACT

A plug-fastener for safety belts in motor vehicles, which comprises a tongue-like plug part and a receiving part for receiving and retaining the tongue-like plug part. The plug part is provided with at least one recess, undercut, or a shoulder. The receiving part comprises at least one locking member which engages the recess, undercut or shoulder of the plug part, and, after the plug part has been received by the receiving part, is operable to retain these parts until the parts are separated deliberately. In the receiving part in the path of movement of the plug part there is movably arranged a holding member one end or extension of which is adapted to engage the locking member in its unlocked position and to prevent the latter from moving into its locking position until the plug part has contacted the holding member and has moved it out of engagement with the locking member.

6 Claims, 9 Drawing Figures

PLUG-IN FASTENER FOR MOTOR VEHICLE SAFETY BELTS

This is a continuation application of parent application Ser. No. 921,262-Seel filed July 3, 1978, now abandoned.

The present invention relates to a plug-in fastener for motor vehicle safety belts, comprising a tongue-like plug part and a receiving part designed and equipped to receive and retain said tongue-like plug part. The plug part is provided with at least one recess or an undercut, or a shoulder. The receiving part contains at least one locking member which after the parts have been brought together engages the recess or the undercut, or the shoulder, of the plug part and thereby retains the plug part in the receiving part until the parts are separated deliberately.

With heretofore known plug-in fasteners of this type, the tongue-like plug is provided with an eye integral therewith, through which passes the chest/pelvis section of a three-point safety belt. The tongue-like plug may be flat or, for example, may be in the form of a cylindrical pin. The receiving part is fastened to the upper end of a flexible or rigid anchoring part which in turn, is connected to the vehicle floor. The receiving part may, however, also be attached directly to the seat. An embodiment of this type is disclosed, for instance, in German Offenlegungsschrift No. 1 781 420.

An important requirement to be met by plug-in fasteners of this type is the possibility of safe one-hand operation, that is, the person who wishes to attach the safety belt should be able with one hand to grip the belt loop comprising chest belt and pelvis belt, together with the plug part located thereon, and to engage the plug part securely in the receiving part, namely, without inspection and spatial checking of the correct closure. Experience has shown that the plug part is generally plugged into the receiving part very quickly and without attention being paid to the plugging direction and sufficiently deep insertion into the receiving part. While many drivers, after the fastening operation, by a brief pull, check whether the closure has been properly established, this pull by hand does not correspond to the tensile or pulling forces which can occur in an accident. Therefore, it cannot at once be ascertained whether the fastening parts are not properly engaged, and e.g. only one edge of the locking member has come into contact with an edge of the plug part-undercut, because the plug part has not been introduced carefully enough. While such a faulty or deceiving locking engagement can withstand small tensile forces, the edges of the parts when acted upon by large forces may slip off and, consequently, may cause the fastener to open. The danger of unnoticed incorrect locking is obvious.

It is, therefore, an object of the invention to provide a plug-in fastener for motor vehicle safety belts, in which incorrect or faulty locking is excluded, while the conventional ease of locking is to be maintained, as well as the ejection of the plug part after the locking member has been released.

These and other objects and advantages of the invention will appear more clearly from the following specification in connection with the accompanying drawings, in which:

FIGS. 1 and 1*a* respectively diagrammatically illustrate a proper locking and a faulty or seeming locking.

Figures 1, 1A:
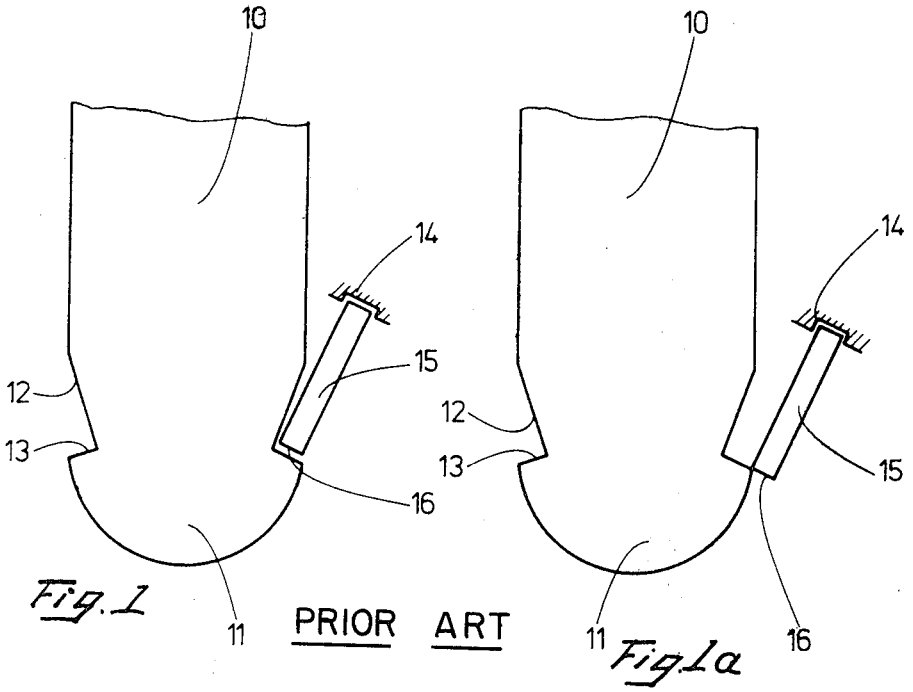
Fig. 1 PRIOR ART Fig. 1a

The plug-in fastener according to the invention is characterized primarily in that in the receiving part in the path of the plug part there is arranged a holding member one end, or the extension or the like of which engages the locking member in its unlocked position and prevents the latter from moving into its locking position until the plug part has touched the holding member and has moved it out of engagement with said locking member.

The design according to the invention has the effect that the locking member is kept disengaged until the plug part has been introduced correctly, that is completely, into the receiving part. If correct introduction does not take place, the locking member cannot engage, so that the person notices virtually instantaneously that the fastener has not been fastened at all. In such an instance, the force of the return spring of the conventional belt reeling mechanism is sufficient to pull the plug part out of the receiving part again. With heretofore known plug-in fasteners with possible incorrect or seeming locking, the return spring is, however, generally not capable of overcoming the edge contact between the parts.

Moreover, the invention presents the advantage that the locking member which is retained by the holding member in the "waiting position" does not need to be pushed away by the inserted plug part. This means that frictional wear in the lock is substantially reduced, so that a longer lifespan can be expected.

Referring now to the drawing in detail, FIGS. 1 and 1*a* respectively show two schematic illustrations of a tongue-like plug part 10 to which the seat belt (not shown) is attached), hereinafter referred to as locking tongue, with mushroom-shaped head 11, which is so shaped as to provide undercuts 12 with abutment faces or shoulders 13. On the receiving part 14, (see FIGS. 2 and 4) which anchors the belt only roughly indicated, in FIG. 1 there is pivotably mounted a locking member 15 which in this case is plate-shaped, and whose engaging face 16 is intended to interact with the face 13 of the locking tongue.

The illustration on the left side in FIG. 1 clearly shows a proper locking of the tongue 10 by the locking member 15. The tongue 10 cannot be pulled upwards even with a large force. The illustration on the right side in FIG. 1 on the other hand shows an incorrect or seeming locking where only one corner or edge of the locking face 16 is in contact with a corner or edge of the tongue face 13. It is possible that small forces can be absorbed thereby, but under the influence of larger forces, the parts 10 and 15 slip off one another, so that the tongue 10 can easily be pulled upwards.

Figure 2:
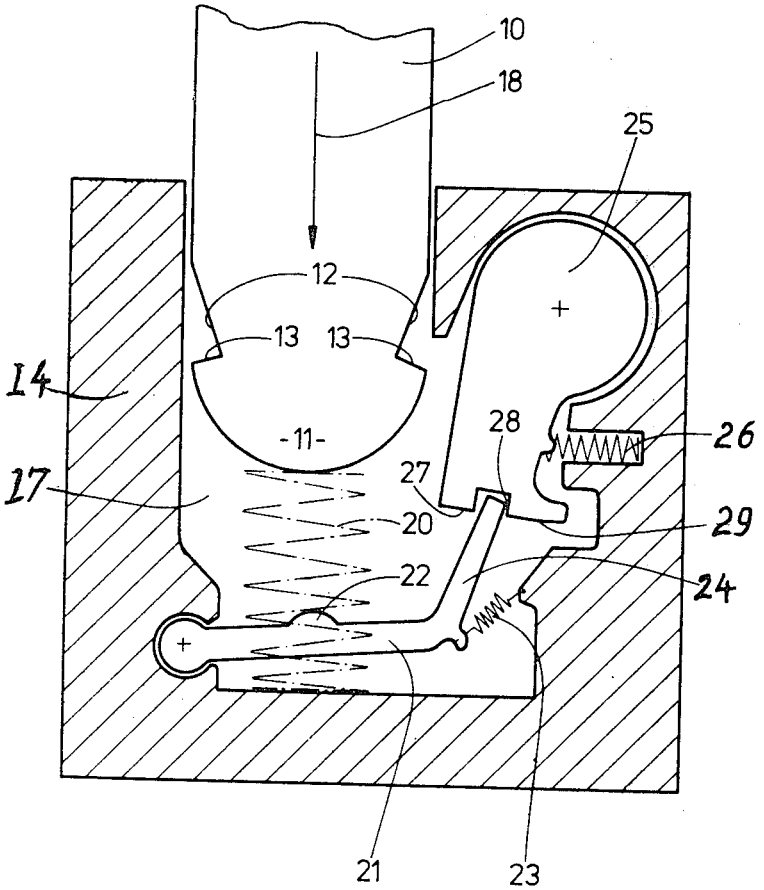
FIG. 2 is a schematic longitudinal section through a plug-in fastener at the moment of introduction of the plug part.
Figure 4:
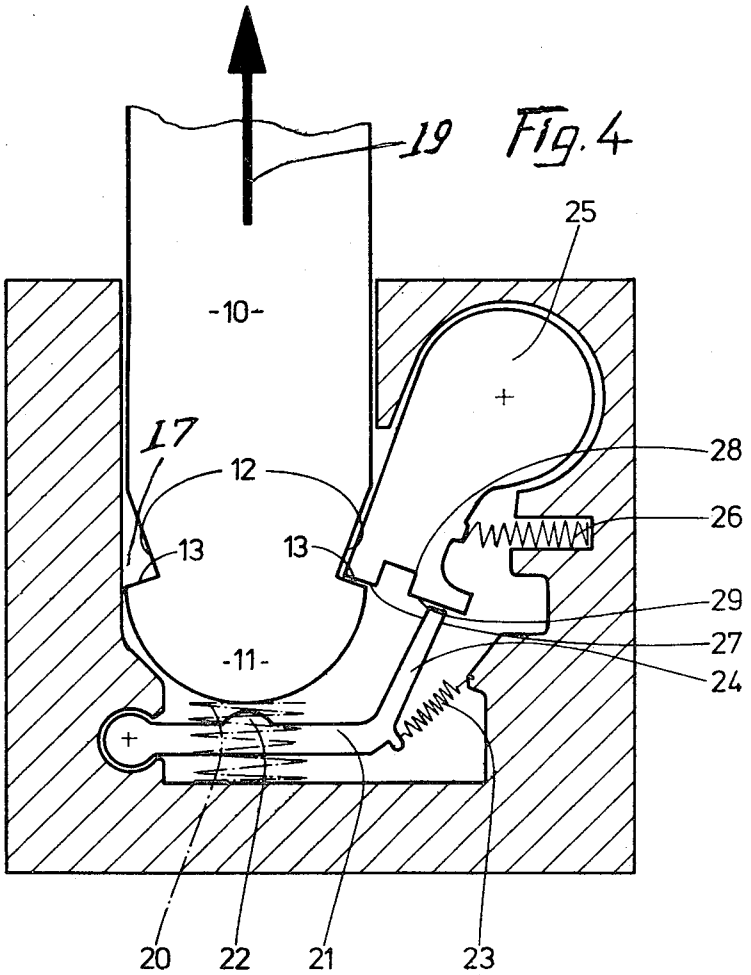
FIG. 4 is an illustration similar to that of FIGS. 2 and 3 in the locked condition.

FIGS. 2 and 4 show the entire receiving part 14, hereinafter referred to as locking housing or housing. It defines a slot or channel 17 for the locking tongue 10 in which the latter travels when it is plugged in and pulled out. The plug-in direction of the tongue 10 is indicated by an arrow 18 and the pull-out direction is indicated by an arrow 19. The different sizes of the arrows 18 and 19 respectively symbolize the different forces occurring in connection therewith.

Arranged upright on the bottom of the housing 14 is an ejector spring 20 which extends into the channel 17 and consequently into the path of the tongue 10, so that the latter can be introduced into the housing 14 only against the force of said spring 20. Spring 20 can be made relatively light, because it needs to lift only the weight of the locking tongue 10 and to eject it.

Figure 3:
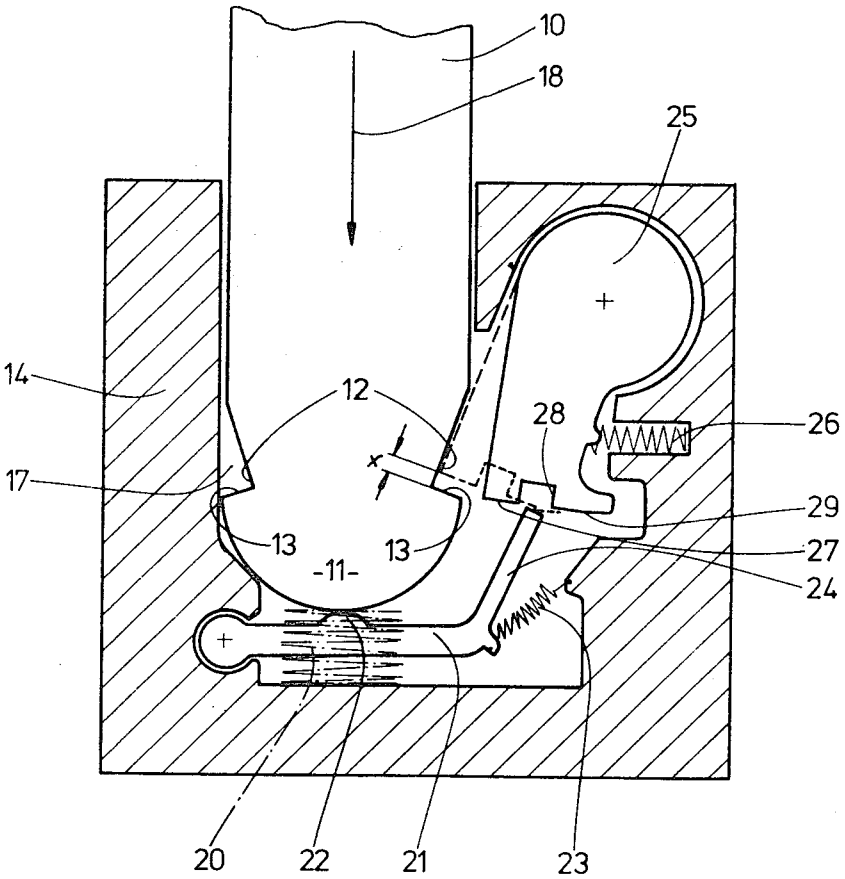
FIG. 3 is an illustration similar to that of FIG. 2 but with the plug part introduced completely.

Pivotally mounted in the lower side wall of the channel 17 is a holding member 21 in the form of an angle lever which crosses the path of introduction of the tongue 10 and along the axis of this path is provided with a wear-resistant reinforcement 22. The reinforcement 22 is intended for contact with the tip or leading edge of the mushroom head 11 of the tongue 10. A spiral tension spring 23 connects the angle lever 21 to the housing 14 in such a way that the angle lever 21 is pulled upwards in FIGS. 2 to 4. The angled off end 24 of lever 21 is detachably connected to a locking member 25 which is pivotably mounted laterally of the channel 17 in the housing above the angle lever 21 to project through an opening in the channel. The mounting is so provided to constrain the locking member that a section of the locking member 25 will be able, due to the thrust of a spring 26, to spring forward into the channel 17 and, consequently, in to the path of the locking tongue 10 (FIGS. 3 and 4). When the locking tongue 10 is introduced correctly, an abutment face 27 of the locking member 25 comes to rest against the face 13 on the tongue 10.

For purposes of detachably interconnecting the angle lever 21 and the locking member 25, a recess 28 is provided on the bottom side of the locking member which recess is engaged by the angled-off end 24 of the angle lever 21 when lever 21 has by spring 23 been moved into its upper position. In this connection the locking member 25 is pivoted in an anti-clockwise direction, and the spring 26 is loaded. The face 27 is located completely outside the limit of the channel 17 as can be seen from FIG. 2.

When the locking tongue 10 is inserted into the channel 17 of the housing 14, the force of the spring 20 is overcome, and the tongue 10 is introduced until it contacts the reinforcement 22. At this time there still no locking occurs. When the tongue 10 is pushed further into the housing 14, it presses the angle lever 21 downwards and the spring 23 is loaded. The tip of the angled-off end 24 finally leaves the recess 28 of the locking member 25, so member 25 can pivot in a clockwise direction due to the thrust of spring 26 and can enter the clear space of the channel 17. This takes place abruptly. When the tongue 10 is now released, its face 13 comes up against the face 27 of the locking member 25, so that the desired engagement is completed. The angle lever 21 rests with the tip of its part 24 against a face 29 of the locking member 25 (FIG. 4).

When the locking parts are separated deliberately, that is, when the safety belt is to be taken off from the respective user, the locking member 25 is pivoted in an anti-clockwise direction. As a result thereof, part 24 of the angle lever 21 again engages the recess 28 and retains the locking member 25 in its ready for use position. The locking tongue 10 is now free and is ejected upwards out of the channel 17 by the spring 20.

As will be seen from FIG. 3, the plug-in path for the locking tongue 10 is selected so long that an overstroke x is produced between the face 13 provided on the tongue 10 for engagement by the locking member 25, and the corresponding face 27 of the locking member 25. The overstroke x amounts to approximately 1–2 mm. This step materially contributes to a safe locking.

Figure 6:
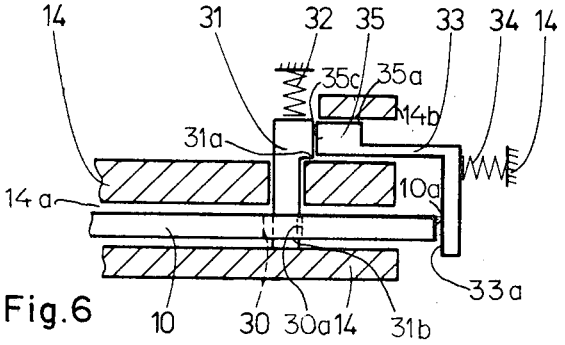
FIG. 6 is an illustration similar to that of FIG. 5 in the locked condition.
Figure 5:
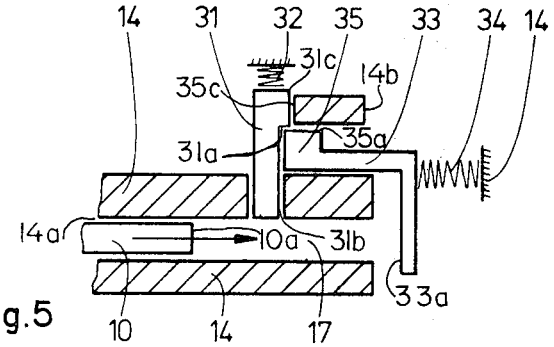
FIG. 5 is a schematic cross section of another fastener embodiment with apertured plug part and locking bolt, with the plug part being introduced.

FIGS. 5 to 8 show alternative embodiments of locking tongues with conventional hole-like recesses which define shoulders for engagement by a detent to prevent disengagement of the tongues. In FIGS. 5 and 6, the locking tongue or plug part 10 with hole or cut-out means 30 moves in the channel 17 of the housing 14. The cut-out 30 defines a shoulder **30*a* which faces in the opposite direction from the leading edge 10*a* of the tongue 10. Provided as locking member is a detent or bolt 31 which by the thrust of a first spring 32 can be moved into the opening or hole 30 transversely to the slot and the plug-in direction of the tongue 10, in order to lock the tongue 10 by engaging the shoulder 30*a* with an abutment surface 31*a*. The holding member or trigger in this instance has the design of an angular slide 33 made of a single piece which is under the thrust of a second spring 34 and engages a first surface 35*a* of shoulder 35 behind a corresponding nose of the locking member 31 when the plug-in fastener is open. If the slide 33 crossing the plug-in path of the tongue 10 with surface 33*a* is pushed away by the tongue 10 against the thrust of the spring 34, the shoulder 35 slides under said nose of the locking member 31, and the locking member, actuated by the spring 32, can engage or lock into the tongue 10. This is, therefore, possible only if the tongue 10 has been correctly introduced into the housing 14. The detent 31, first spring 32, trigger 33 and second spring 33 form a locking mechanism which holds the tongue 10 in the housing 14 which defines the slot 14*a*. A surface on housing portion 14*b* cooperates with a parallel surface 14*c* on the housing 14 to constrain motion of the trigger 33 to sliding motion. Furthermore, the trigger 33 has a third surface 35*c* which is juxtaposed with a second abutment surface 31*c* on the detent 31. The surface 35*c* on the trigger 33 is displaced a distance from the surface 33*a* on the trigger which is slightly greater than the distance from the shoulder 30*a* on the tongue 10 to the leading edge 10*a* of the tongue. When the detent 31 is retracted to release the tongue 10, the surface 31*b* clears the surface 35*c* so that the detent is held completely retracted allowing free withdrawal of the tongue 10**.

Figure 8:
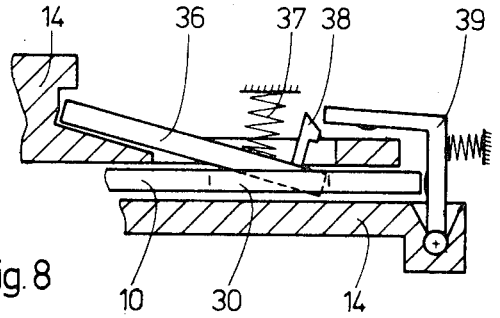
FIG. 8 is an illustration similar to that of FIG. 7 in the locked condition.
Figure 7:
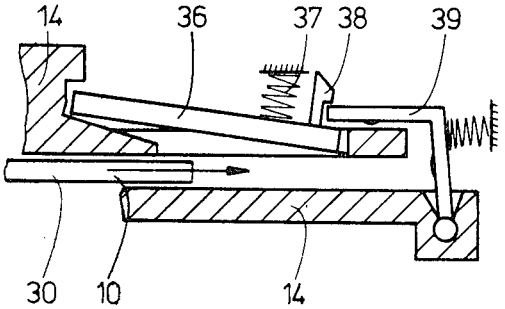
FIG. 7 is a schematic cross section of still another fastener embodiment with locking plate, with the plug part being introduced.

FIGS. 7 and 8 likewise relate to a tongue 10 with a rather larger hole 30. However, in this embodiment, as locking member there is provided a plate-shaped pivotal lever 36 which is under the pressure of a spring 37 and has at its rear end an attachment in the form of a hook 38 adapted to be engaged by the end of an angle lever 39 corresponding substantially to the angle lever 21 according to FIGS. 2 to 4, when the plug-in fastener is in its ready for use position. When the tip of the locking tongue 10 upon complete insertion strikes the angle lever 39, the latter releases the hook 38 and, consequently, also the locking member 36, so that the latter due to the thrust of spring 37 can spring into the hole 30 of the tongue 10. Also in this instance, the locking occurs only after the tongue 10 has been completely inserted. Prior thereto, no contact between the parts 10 and 36 occurs.

It is, of course, to be understood that the present invention is, by no means, limited to the specific showing in the drawings, but also comprises any modifications within the scope of the appended claims.

What I claim is:

1. A fastener in combination with a motor vehicle seat belt wherein the fastener comprises:

an elongated tongue attached to the belt, said tongue having a leading edge and a recessed portion displaced longitudinally from the leading edge, the recessed portion including a shoulder which faces in the opposite direction from the leading edge;

a housing for anchoring the belt, the housing including a slot for receiving the tongue, the slot having a lateral opening therein positioned adjacent to the shoulder on the tongue when the tongue is inserted into the slot;

a locking mechanism for holding the tongue in the slot at a particular position to insure that the tongue will not slip from the slot when a longitudinal inertial force is placed on the tongue, the locking mechanism including:

a detent mounted adjacent the opening in the housing for projection and retraction through the lateral opening, the detent having first and second abutment surfaces thereon facing in the same direction as the leading edge of the tongue when the tongue is inserted into the slot, the second abutment surface being positioned outside of the slot regardless of whether or not the detent is projected or retracted;

first spring means disposed between the detent and housing for urging the detent through the opening in the slot to abut the first abutment surface with the shoulder on the tongue means to thereby lock the tongue means in the slot;

shoulder means positioned on the detent means and facing the slot at a location external of the slot when the detent is held out of the slot against bias of the first spring means;

a rigid, unitary trigger means having a first surface thereon outside of the slot and facing the shoulder on the detent means to hold the detent means retracted upon engaging the shoulder on the detent means, the trigger means having a second surface thereon extending across the slot and displaced inwardly of the opening for engagement by the leading edge of the tongue when the tongue is inserted into the slot, and the trigger means having a third surface facing the second abutment surface of the detent, the third surface being displaced from the second surface by a distance slightly greater than the distance between the shoulder on the tongue and the leading edge of the tongue, means for constraining movement of the trigger between a detent retaining position in which the first surface of the trigger means engaged the shoulder on the detent and a release position in which the first surface is displaced from the shoulder on the detent allowing the detent to project and engage the shoulder on the tongue said constraining means positioning the trigger means in its release position with the second surfaces thereof spaced a distance from the abutment surface of the detent which distance is slightly greater than the distance between the shoulder on the tongue and the leading edge of the tongue, and second spring means positioned adjacent to the end of the slot and engaging the trigger means for urging the trigger means toward the detent;

whereby:

the detent is held retracted by the first surface of the trigger means until the leading edge of the tongue has moved far enough into the slot to abut the second surface of the trigger means and to move the first surface of the trigger means out of engagement with the shoulder on the detent to allow the detent to project and lock the tongue, and whereby when the detent is withdrawn to release the tongue, the third surface of the trigger means clears the second abutment surface of the detent and the second spring means pushes the trigger means to position the second surface of the trigger means beneath the shoulder means on the detent to hold the trigger beneath the shoulder means on the detent to hold the detent retracted so that the tongue can be freely withdrawn.

2. The fastener of claim 1 wherein the means for constraining the trigger means includes two parallel surfaces which are parallel with the slot wherein the surfaces receive the trigger means therebetween and constrain the trigger means to sliding movement.

3. The fastener of claim 1 wherein the means for constraining the trigger means includes a pivotal mounting for the trigger means.

4. A plug-in fastener according to claim 1, in which said trigger comprises a lever pivotally mounted in said housing on one side of the path of movement of said tongue, and in which said detent is pivotally mounted in said receiving part on the other side opposite said one side of the path of movement of said tongue.

5. A plug-in fastener according to claim 1, in which said detent comprises a hook for engagement by said trigger.

6. A plug-in fastener according to claim 1, in which said second surface of said trigger which is engageable by said tongue is provided with a wear-resistant reinforcement.

* * * * *